US006203409B1

(12) United States Patent
Kennedy et al.

(10) Patent No.: US 6,203,409 B1
(45) **Date of Patent: *Mar. 20, 2001**

(54) COMBINATION LENS EDGER, POLISHER, AND SAFETY BEVELER, TOOL THEREFOR, AND USE THEREOF

(75) Inventors: Brian H. Kennedy, Charlottesville; Lewis D. Houchens, Jr., North Garden, both of VA (US)

(73) Assignee: National Optronics, Inc., Charlottesville, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 08/841,804

(22) Filed: May 5, 1997

Related U.S. Application Data

(63) Continuation of application No. 08/316,780, filed on Oct. 3, 1994, now Pat. No. 5,626,511.

(51) Int. Cl.[7] ..... B24B 9/14; B24B 9/20

(52) U.S. Cl. ..... 451/43; 451/461

(58) Field of Search ..... 451/461, 43, 240, 451/255, 256; 408/22, 24, 26, 27

(56) References Cited

U.S. PATENT DOCUMENTS

| | | | | |
|---|---|---|---|---|
| 1,449,266 | * | 3/1923 | Clarke | 451/240 |
| 3,828,648 | * | 8/1974 | Geula | 451/240 |
| 4,841,676 | * | 6/1989 | Barwasser | 451/461 |
| 4,908,996 | * | 3/1990 | Friedman et al. | 451/43 |
| 5,158,422 | * | 10/1992 | Wagner | 451/43 |
| 5,410,843 | * | 5/1995 | Gottschald | 451/43 |
| 5,626,511 | * | 5/1997 | Kennedy et al. | 451/461 |
| 5,711,700 | * | 1/1998 | Raffaelli | 451/43 |

OTHER PUBLICATIONS

German Notice of Opposition, No. 95114178.7–2302/0705660, Mailed May 11, 2000 and cited references.

National Optronics Price List, effective Mar. 1, 1993.

* cited by examiner

*Primary Examiner*—Robert A. Rose
(74) *Attorney, Agent, or Firm*—Liniak, Berenato, Longacre & White, LLC

(57) ABSTRACT

A combination tool for edging and polishing the edge of eyeglass lenses comprises an axially extending rotatable cutter body having first and second peripherally disposed and axially extending cutter portions. Each cutter portion has a first notch therein for shaping an edge of a lens. The first notches are equiaxially spaced along the body. An axially extending polishing tool is secured to the body and is rotatable therewith. The tool has a second notch formed therein for shaping an edge of a lens. An abrasive coating is applied to the polishing tool for polishing the lens edge.

19 Claims, 4 Drawing Sheets

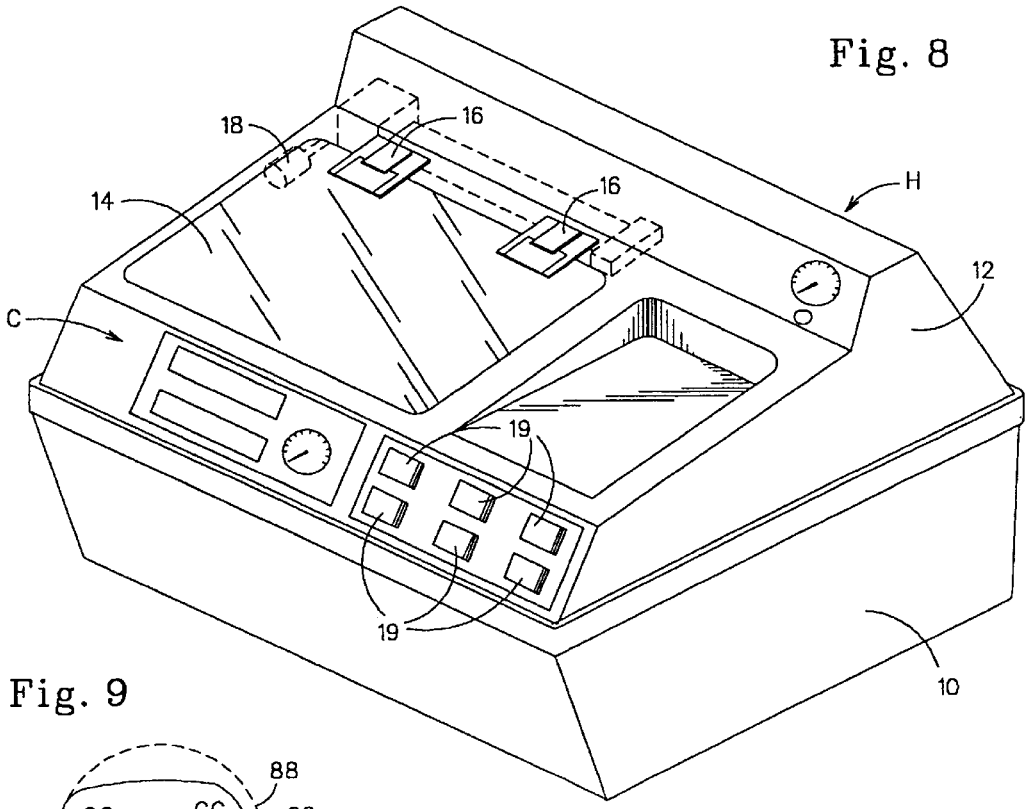
Fig. 8
Fig. 9
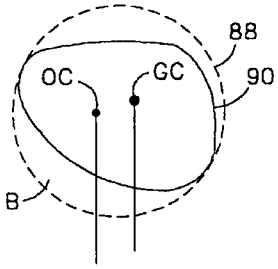
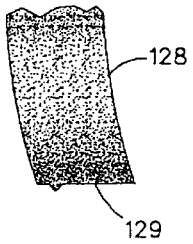
Fig. 10a
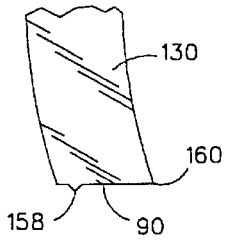
Fig. 10b
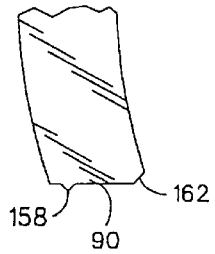
Fig. 10c

COMBINATION LENS EDGER, POLISHER, AND SAFETY BEVELER, TOOL THEREFOR, AND USE THEREOF

This is a continuation, of application Ser. No. 08/316,780 U.S. Pat. No. 5,626,511, filed Oct. 3, 1994.

FIELD OF THE INVENTION

The invention is a machine for edging, polishing, and safety beveling the edge of an eyeglass lens. The machine utilizes a two-part tool for edging the lens to an initial predetermined size and configuration, thereafter polishing the resulting edge with a diamond bonded polishing tool, and then forming a safety bevel about the inner corner. The method of the invention is implemented when the two-part tool is engaged with a rotating lens blank, with a water spray being directed at the tool during the polishing and safety beveling operations. The polishing tool of the invention may be used with lenses formed of glass and polymeric materials.

BACKGROUND OF THE INVENTION

Many eyeglass lenses are manufactured today from polymeric materials, including polycarbonate material. Polymeric or plastic lenses are preferred by consumers in part because of their reduced weight, which increases user comfort when the eyeglasses need to be worn for an extended period. The lens blank is frequently cast in circular configuration, so that each blank needs to be edged, or shaped, to size in order to thereafter be mounted in the frame which has been selected. A further requirement is that a safety bevel be formed about the lens, particularly adjacent the wearer.

Eyeglass frames have two spaced openings in which the finished lenses are mounted. The lens openings come in any number of sizes and configurations. Because there is no standard shape or size, nor a standard prescription, then the optician must shape each lens in a machine, known as an edger, preparatory to fitting the lens into the frame opening.

The frame openings frequently have a bevel or a groove which interfits with a complementarily shaped groove or bevel, respectively, formed about the peripheral edge of the lens. The interfit between the complementary bevel and groove helps to secure the lens within the opening, thereby preventing removal as otherwise could occur. The edging machine forms the bevel or groove about the lens. The position of the bevel or groove is not necessarily fixed relative to the front or back surfaces of the lens, so the edging machine may need to take into account not only formation of the bevel or groove but also where that bevel or groove is to be positioned intermediate the lens surfaces.

Some eyeglass frames have openings which do not completely encircle the lens. The bevel or groove is still provided in order to snap into the frame position, and the bevel or groove is continuous about the lens edge. When a lens is edged, the resulting edge will frequently have a smokey appearance caused by microscopic grooves scored into the edge by the grinding or cutting tool. The smokey finish is undesirable for those frames which have an opening not completely encircling the lens, and the smokey finish should be removed. Polishing is one technique used to remove this smokey finish in order for the finished lens to be acceptable to the user.

The lens edge may be polished through various means in order to remove the smokey finish. Removal of the lens from the edger to permit polishing on a subsequent machine is inconvenient, both because of increased cost and the possibility of loss, damage, or the like, to the lens. Polishing is one of the last steps prior to placing the lens into the frame, so damage to the lens is to be avoided because of the costs already accrued in forming the lens.

Edging of the lens, whether made of glass or polymeric material, can result in a sharp corner at the intersection of the inner surface and the peripheral edge. The sharp corner may present a safety concern, and therefore should be removed. A bevel may be ground about the lens in order to remove the sharp corner, thus forming an angled surface known as a safety bevel.

The disclosed invention is a dry edger which utilizes a two-part combination tool for edging the lens to an initial predetermined size and configuration with a first part of the tool, thereafter with a second part of that same tool completing the edging and size reduction process through a diamond bonded polishing tool which removes the smokey appearance on the edge, and then forming a safety bevel with that same second part. The combination tool of the invention avoids the need to remove the lens from the edger for polishing and safety beveling, thus minimizing handling and damage costs. Polishing of the edge by the polishing tool is facilitated by a water spray directed at the polishing tool. A vacuum removes the water droplets and lens blank particles from the interior of the edger cabinet, thus avoiding damage to electrical components and the like.

SUMMARY OF THE INVENTION

A tool for edging and polishing the edge of an eyeglass lens comprises an axially extending rotatable cutter body having first and second radially disposed and axially extending cutter portions. Each cutter portion has a first notch therein for shaping an edge of a lens. The notches are equiaxially spaced along the body. An axially extending polishing tool is secured to the body and is rotatable therewith. The polishing tool has a second notch formed therein for shaping an edge of a lens. The polishing tool has an abrasive coating applied thereto for reducing and polishing the lens edge.

A combination tool for edging and polishing the edge of an eyeglass lens comprises a longitudinally extending generally cylindrical body rotatable on the axis thereof, and a longitudinally extending generally cylindrical polishing tool secured to the body and rotatable therewith. The body includes an edger securable end portion and an oppositely disposed tool contacting portion. The tool contacting portion has an annular radially extending shoulder and an axially extending projection. A bore extends through the shoulder into the body, and the bore is intermediate the projection and the periphery of the body. A threaded bore extends into the projection. The polishing tool has a distal end portion and an oppositely disposed body contacting portion. The body contacting portion includes an annular shoulder and first and second bores, the first bore sized and configured to accept the projection and the second bore sized and configured to correspond to the body shoulder bore. A third bore extends axially through the polishing tool from the distal end portion to the first bore. A bolt extends through the first and third bores, and has a threaded end portion received within the threaded bore for securing the body and the tool. A pin is positioned within the shoulder bore and the second bore for aligning the polishing tool relative to the body.

A machine for edging and polishing the edge of an eyeglass lens comprises a first table selectively movable in a first direction, and first drive means for moving the first table in the first direction. A lens clamping and rotating assembly is secured to the first table and is movable therewith. The assembly includes means for selectively rotating a lens about a first axis extending transverse to the first direction. A second table is selectively movable in a second direction perpendicular to the first direction and parallel to the first axis. Second drive means are provided for moving the second table in the second direction. A tool is mounted to the second table and is movable therewith. The tool is rotatable on a second axis parallel to the first axis. The tool includes a notched edging portion and a notched abrasive coated polishing portion, and there are means for rotating the tool. A nozzle is secured to the second table and is movable therewith. The nozzle is adjacent to and aligned with the polishing portion for selectively directing a fluid thereto.

A method of edging and polishing the edge of an eyeglass lens comprises the steps of providing a lens blank having an edge. The blank is rotated about the geometric axis thereof. The edge is engaged with a rotary cutter which causes the edge and the blank to achieve a first distressed configuration. The edge is thereafter engaged with a notched rotary cutter for thereby causing the edge to have a bevel formed thereabout. The edge is thereafter engaged with a notched, abrasive coated rotary polishing tool so that the bevel is positioned within the notch of the tool and the edge and bevel are thereby caused to achieve a second polished configuration.

A tool for polishing and safety beveling a lens comprises a generally cylindrical body having first and second spaced end portions. The body is rotatable on the axis thereof. A chamfer is formed about the second end portion. The chamfer extends from the periphery of the body toward the axis and the second end portion. An abrasive coating is bonded to the body throughout the periphery thereof.

These and other objects and advantages of the invention will be readily apparent in view of the following description and drawings of the above-described invention.

DESCRIPTION OF THE DRAWINGS

The above and other objects and novel features of the present invention will become apparent from the following detailed description of the preferred embodiment of the invention illustrated in the accompanying drawings wherein:

FIG. 8 is a perspective view of the enclosure of the edger of the invention;

FIG. 9 is a schematic view of a lens blank and the lens to be formed therefrom;

FIG. 10(a) is a fragmentary elevational view of an edged lens blank having a distressed finish;

FIG. 10(b) is a fragmentary elevational view of the lens blank of FIG. 10(a) having a polished finish; and FIG. 10(c) is a fragmentary elevation view of the lens blank of FIG. 10(b) with a safety bevel.

DETAILED DESCRIPTION OF THE INVENTION

Figure 1:
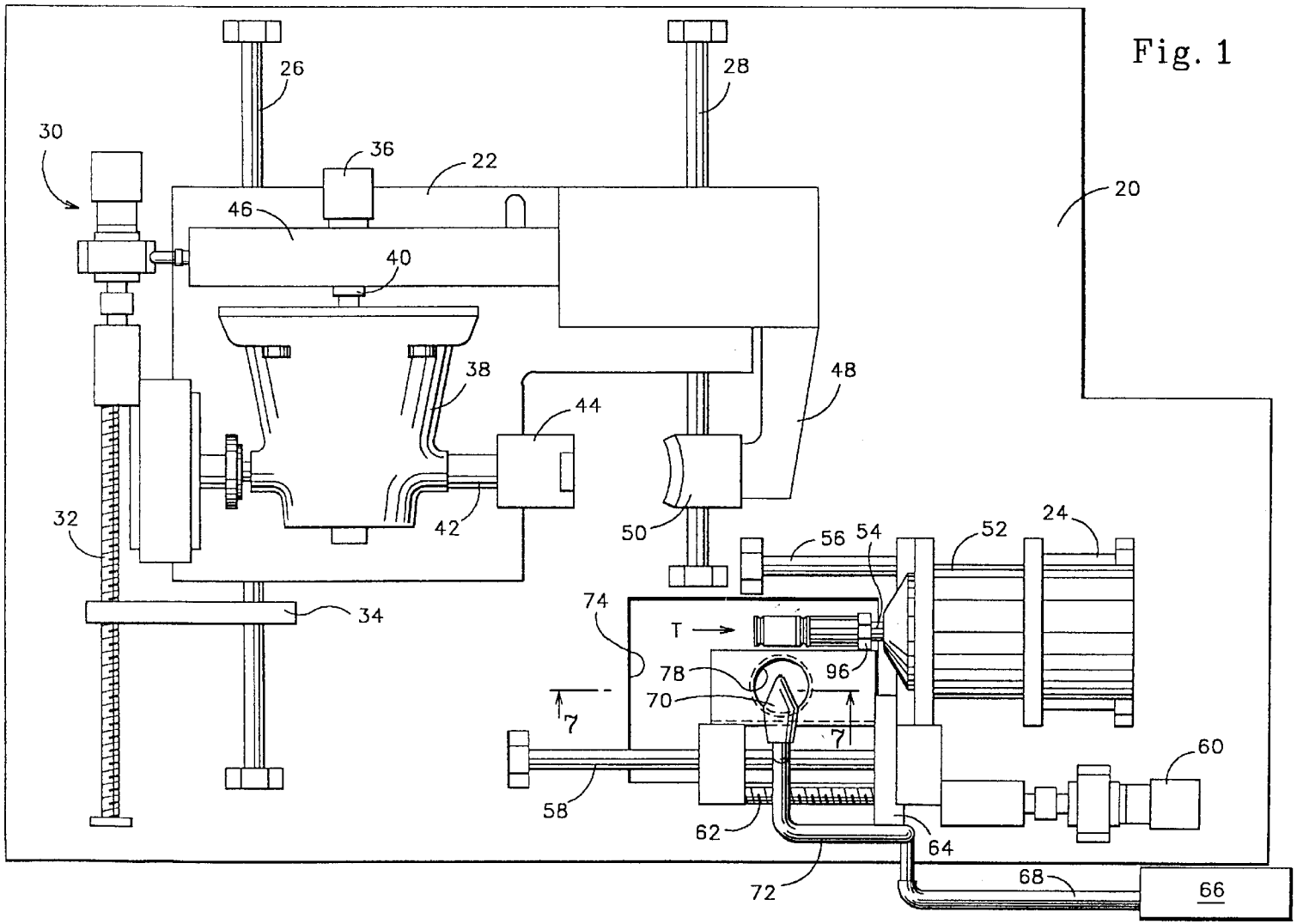
FIG. 1 is a plan view, partially in schematic, of the edger of the invention.

The edger H of the invention includes a housing, as best shown in FIG. 8, which encloses the components, while permitting operator access to the controls. Edger H includes a lower housing portion 10 to which upper housing portion 12 is hingedly connected. Upper portion 12 has a window 14 which may be opened by means of hinges 16 to permit operator access to the interior of the housing. Switch 18 is secured to window 14 and pivotal therewith, and prevents operation of edger H while the window 14 is in the raised position. Control panel C is mounted to a vertical portion of upper portion 12 and provides access by the optician to various controls, collectively 19, used in the invention.

The edger H preferably is a three-axis dry edger, such as the Horizon® III edger manufactured and sold by National Optronics, Inc., the assignee hereof. The edger H has a base plate 20, as best shown in FIG. 1, to which tables 22 and 24 are mounted for movement perpendicular to each other. We prefer that the edger be a three-axis edger, because a three-axis edger does not require mechanical patterns.

Rails 26 and 28 are secured to base 20 and extend in parallel in a first direction relative to base 20. First table 22 is slidably mounted to rails 26 and 28 for movement therealong in the first direction. Servomotor drive 30 is mounted to base 20 adjacent rail 26, and is operably connected to rotary screw 32 for causing controlled rotation thereof. Bracket 34 is secured to first table 22 along the forward edge thereof. Bracket 34 incorporates a ball nut threadedly engaged with rotary screw 32, so that rotation of screw 32 causes corresponding displacement of the ball nut and hence of bracket 34 and table 22. Those skilled in the art will understand that the combination of servomotor drive 30, rotary screw 32, and the ball nut of bracket 34 provide precise positioning of the table 22 relative to the base 20, although other types of drives may be used in place of servomotor 30. The servomotor drives disclosed herein provide position feedback data, so that the location of the component of interest is always known with a high degree of accuracy.

Servomotor drive 36 is mounted to and carried by table 22, and is operably connected to transmission 38 through motor coupling 40. Shaft 42 extends from transmission 38 in a direction transverse to the first direction defined by rails 26 and 28. Shaft 42 is controllably rotated with precision because of servomotor drive 36 acting through transmission 38. Clamp assembly 44 is secured to the end of shaft 42, is rotatable therewith, and is adapted for engagement with an edging block removably secured to lens blank to be edged.

Pneumatic lens clamp cylinder 46 is secured to first table 22 above drive 36, and the extensible piston thereof is operably engaged with arm 48 for causing movement thereof. Arm 48 carries second clamp assembly 50 which is adapted for engaging a lens blank. Actuation of clamp cylinder 46 by the optician through one of the controls 19 causes displacement of clamp assembly 50 either toward or away from clamp assembly 44, thereby clamping or releasing a lens blank. Those skilled in the art appreciate that edging of a lens requires the application of a block to a surface thereof, such as by the 3M Leap® System or as disclosed in U.S. Pat. No. 2,982,061. The block is releasably secured to clamp assembly 44 so that rotation of clamp assembly 44 by shaft 42 causes corresponding rotation of the lens blank about the axis of shaft 42. Because of the precision rotation accomplished by servomotor drive 36 and its feedback position data, then the angular position of the clamped lens blank is known by the control system of edger H.

High speed motor 52 is mounted to second table 24, and has a rotary shaft 54. The motor 52 preferably rotates shaft 54 at a speed of 20,000 rpm or more in order to permit the dry edging process to proceed. Tool T is mounted to shaft 54, and is rotatable therewith in order for edging, polishing, and safety beveling the lens blank as will be further described.

Rails 56 and 58 are secured to base 20 and extend in a second direction perpendicular to the first direction defined by rails 26 and 28. Second table 24 is slidably mounted to the rails 56 and 58 for movement in the second direction defined thereby. Servomotor drive 60 is secured to base 20, and drives rotary screw 62. Bracket 64 is secured to second table 24 and has a ball nut threadedly engaged with screw 62, so that rotation of screw 62 by motor 60 will cause corresponding displacement of bracket 64 and hence of second table 24. Because of the precision control provided by servomotor drive 60, rotary screw 62, and the ball nut of bracket 64, then precise positioning of tool T relative to a lens blank clamped between and rotated by clamp assemblies 44 and 50 is achieved in order to permit the edging, polishing, and safety beveling process to proceed.

Water supply 66 is operably associated with base 20, and has a resilient supply line 68, such as provided by flexible rubber tubing, leading to spray nozzle 70. Spray nozzle 70 is secured to bracket 64 by tubing or light pipe 72, thereby maintaining orientation of nozzle 70 relative to tool T as second table 24 slides on the rails 56 and 58. Those skilled in the art will appreciate that pumps and pressure controls are provided in conjunction with water supply 66 so that there is adequate water pressure for droplet formation by nozzle 70.

Figure 7:
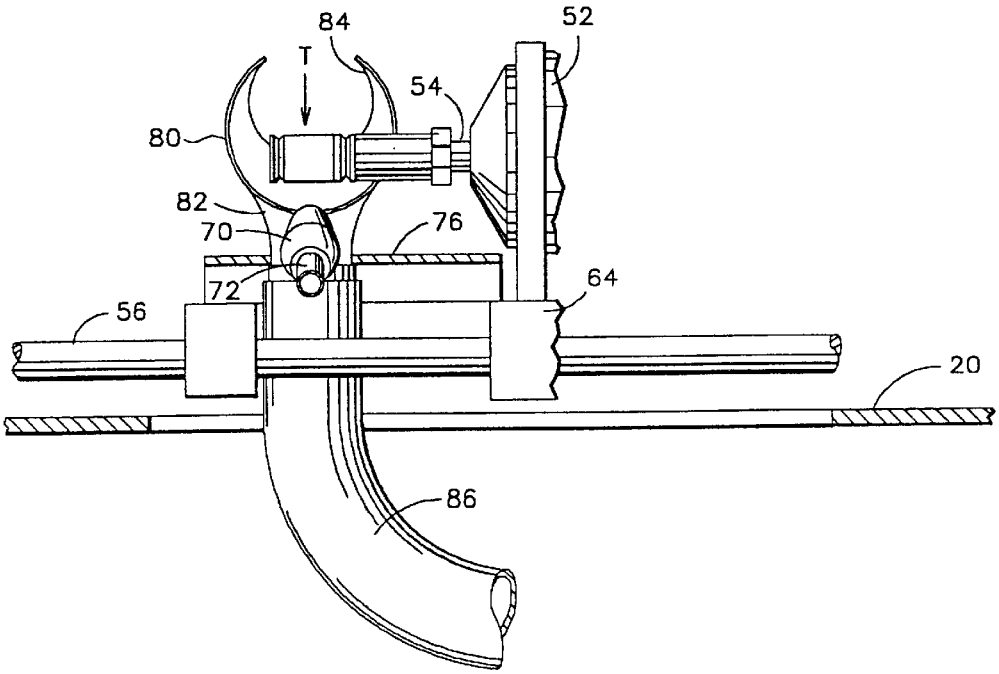
FIG. 7 is a fragmentary elevational view partially in section taken along the line 7—7 of FIG. 1 and viewed in the direction of the arrows.

Rectangular opening 74 is formed in base 20, as best shown in FIGS. 1 and 7. Chip chute 76 is mounted to table 24 through brackets or the like, and defines a plate partially closing opening 74. Aperture 78 is formed in chip chute 76 below tool T, as best shown in FIG. 1. As best shown in FIG. 7, cowl 80 has a duct-like portion 82 fitted within aperture 78 of chip chute 76. Cowl 80 has a slot 84 providing an opening adjacent tool T for permitting a lens blank clamped between assemblies 44 and 50 to be brought into engagement with tool T through operation of servomotor drive 30. Vacuum line 86 is secured to duct 82 below chip chute 76 for applying a vacuum to cowl 80. Vacuum line 86 terminates at a vacuum source, such as provided by an industrial vacuum cleaner, and causes air, particulates, and water mist to be drawn through cowl 80 to the vacuum source. Because of opening 74, then the vacuum line 86 moves with table 24 as the table moves in response to operation of servomotor drive 60. Preferably the vacuum is sufficiently strong to cause air flow over tool T to be of such intensity that heating of tool T is minimized. Heat generation during the edging, polishing, and safety beveling steps is to be avoided, particularly with materials such as polycarbonate.

Those skilled in the art recognize that an eyeglass lens blank frequently is provided in the form of a cast circular blank. FIG. 9 illustrates in dotted line form the periphery 88 of a circular lens blank B. Also illustrated in FIG. 9 in solid line is the periphery 90 that the blank B will achieve upon completion of the edging process. The notation "GC" in FIG. 9 identifies the geometric center of the blank 88, with the designation "OC" identifying the optical center of the finished blank 90. The blank B usually will be rotated about its geometric center by the edger, even though the prescribed optical characteristics are to be achieved at the optical center.

Tool T, as best shown in FIGS. 2–6, is a two-part combination tool incorporating a router R and a polishing hub or tool P. Those skilled in the art understand that a router is a tool for cutting into or below a main surface, and usually operates at a high rotary speed such as provided by motor 52. Router R preferably is a two-bladed router.

Figure 6:
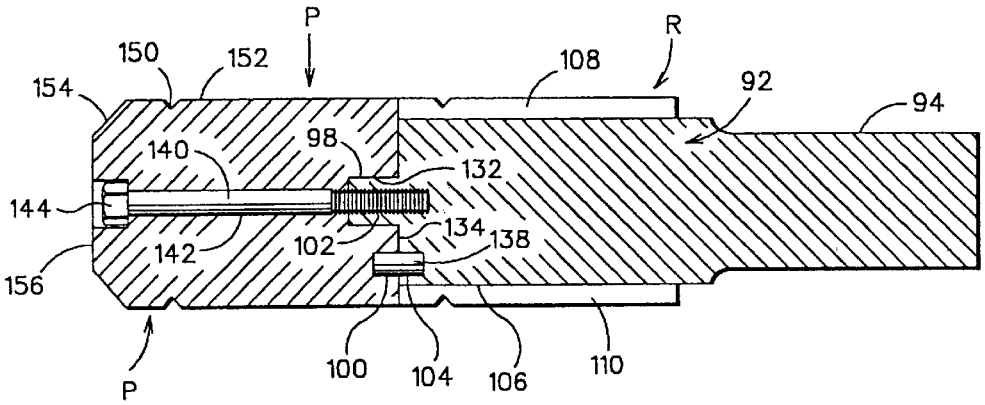
FIG. 6 is a cross-sectional view of the combination tool of the invention.

Router R, as best shown in FIG. 6, is generally cylindrical, and has a body 92 incorporating a reduced diameter first end portion 94 for being secured to shaft 54 through chuck 96. Router R has a second polishing tool contacting end portion incorporating an axially extending cylindrical projection 98 and an annular flat shoulder 100 extending from projection 98 to the periphery 106 of body 92. The router R is preferably manufactured from grade 303 stainless steel. Projection 98 has an internally threaded coaxial bore 102 extending into body 92 from the distal end of projection 98. Opening 104 is formed in shoulder 100, and extends axially inwardly parallel to bore 102 intermediate projection 98 and the periphery 106 of body 92.

Blades 108 and 110 extend angularly outwardly from periphery 106 of enlarged diameter portion 112 of body 92. Each of blades 108 and 110 extends along enlarged portion 112 from shoulder 100 to approximately the proximal end of enlarged diameter portion 112. Each of blades 108 and 110 has a V-shaped notch 114 and 116, respectively, adjacent shoulder 100. The notches 114 and 116 are spaced a common distance along periphery 106, and are aligned so that a single V-shaped bevel is formed on blank B about periphery 90. Each of the blades 108 and 110 is mounted within a recess 118 and is secured within the recess by fasteners 120, as best shown in FIGS. 2–5. Because of the fasteners 120, then the blades 108 and 110 may be replaced as needed. While we have disclosed V-notches 114 and 116, those skilled in the art will appreciate that the configuration and size of the notches may be other than as shown and, alternatively, that each of the blades may have a protrusion intended to form a groove in the blank B.

The periphery 106 of the router R has a V-shaped groove 122 aligned with each of notches 114 and 116, as best shown in FIGS. 2–5. Groove 122 permits the notches 114 and 116 and therefore the blades 108 and 110, respectively, to be precisely oriented relative to the periphery 106. Each of the notches 114 and 116 has a common shape and configuration, thereby facilitating replacement of the blades and assuring that the resulting bevel has the size and shape predetermined thereby.

Blank B, as best shown in FIGS. 2–5, is a polymeric cast blank having optical surfaces 124 and 126 providing the prescribed optical properties for the resulting eyeglass lens of FIG. 9. Although router R should not be used with glass blanks, the polishing tool P may be so used. The edging of the blank B by the router R or other edging tool, such as a grinding wheel, causes the resulting edge to have a smokey or distressed finish 128 as illustrated in FIG. 10(a). The smokey finish 128 is undesirable for those frames in which the opening does not completely encircle the resulting lens. Use of the tool T of FIG. 6 pursuant to the steps illustrated in FIGS. 2–5 causes the resulting edge 90 to have the polished finish 130 of FIG. 10(b), and also the safety bevel 162 of FIG. 10(c). The smokey finish 128 is believed to arise from microscopic score lines formed in the edge of blank B while being edged, such as by the blades 108 and 110. While the cutting surfaces of the blades 108 and 110 are quite precise, those skilled in the art understand that microscopic score lines may occur with all edging tools because of surface imperfections, vibrations, thermal stresses, and similar factors causing the resulting lens edge 129 to achieve the smokey or distressed configuration.

The polishing tool P removes the microscopic score line creating the smokey finish, so that the resulting edge has the polished translucent appearance 130 of FIG. 10(b). The polished appearance is necessary principally with those frames in which the opening does not completely encircle the lens. The combination tool T thus may be used not only when standard edging is to be performed, but also when a polished edge is desired. The dry edger H may therefore be used regardless of the edge finish desired, thus enhancing operating efficiency of the optician and avoiding the costs previously required for polishing in a subsequent or additional machine.

Polishing tool P, as best shown in FIGS. 2–6, is generally cylindrical in configuration, and has an outer diameter corresponding to the diameter defined by the cutting edges between blades 108 and 110. Tool P has throughout the entirety of its lens contacting periphery a 600 grit diamond material bonded thereto, such as provided by Inland Diamond Company. The diamond bond D has a thickness of about 0.125 inches in order to accommodate wear, and provides an abrasive coating with numerous fine cutting edges which remove the score lines and surface imperfections creating the smokey finish of FIG. 10(a). The diamond bond D causes the polishing function to be implemented by the polishing tool P as the tool T is rotated by the motor 52. While we prefer 600 grit diamond bonded in a bronze-iron matrix, the grit could be finer or coarser depending upon the finish desired. In addition, the diamond could be plated onto the tool P.

Polishing tool P has a router engaging end portion comprising a first bore 132 sized and configured to receive projection 98, and a radially outwardly extending flat shoulder 134 mating with shoulder 100 of router R, as best shown in FIG. 6. Bore 136 extends through shoulder 134, and is aligned with opening 104 for receiving pin 138 therein. Pin 138 is received within the aligned coaxial bores 136 and 104 in order position the polishing tool P relative to the router R, and for preventing rotation therebetween during assembly. The pin 138 preferably is formed of a metallic material, and is removable from the bores 136 and 104 in the event the polishing tool P and router R need to be separated.

Bolt 140 extends through bore 142 in polishing tool P. Bolt 140 has a head 144 received within opening 146. Bolt 140 has a threaded end 148 received within threaded bore 102 for securing the polishing tool P to the router R.

V-notch or groove 150 is formed about the periphery 152 of polishing tool P intermediate the ends thereof. V-notch 150 has the same size and configuration as the notches 114 and 116 of the blades 108 and 110, respectively, in order to cause a bevel of the same size and configuration to be formed when the polishing tool P is used to polish the lens blank B. The V-notch 150 extends continuously about the periphery 152, as illustrated in FIGS. 2–5. As with notches 114 and 116, notch 150 can be any desired size and configuration, preferably matching the size and configuration of notches 114 and 116.

Chamfer 154 extends angularly from periphery 152 to distal end 156, preferably at an angle of 45°. The chamfer 154 provides an angled surface which breaks the sharp corner 160, best shown in FIG. 10(b), formed at the intersection between surface 124 and the edge 90 of the resulting lens. The corner 160 is adjacent the wearer, and thus breaking that corner into the angled shape 162 of FIG. 10(c) promotes safety by reducing the possibility that the wearer may become cut if contacted by that corner. Additionally, corner 160 may be broken to enhance the safety of the optician when installing the blank B into the eyeglass frame. Chamfer 154 extends forwardly and angularly from the periphery 152 toward the axis of rotation. The chamfer 154 terminates at flat distal end 156.

Figure 3:
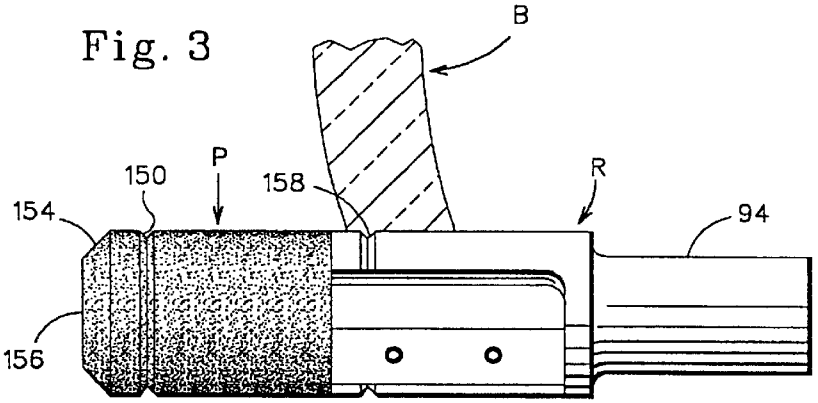
FIG. 3 is an elevational view of the tool and blank of FIG. 2 with a bevel being formed on the edge of the lens blank.
Figure 2:
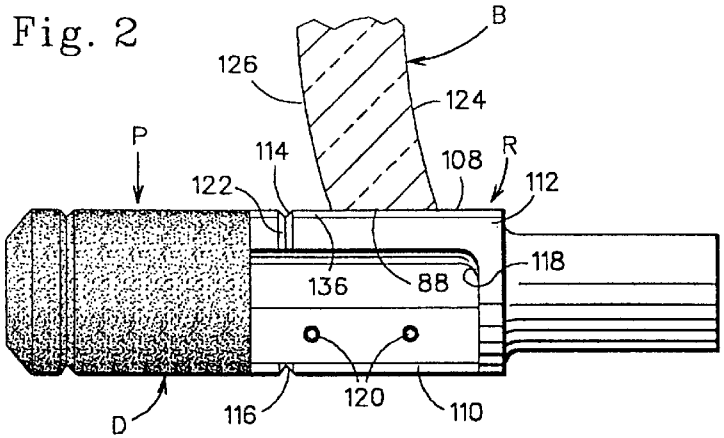
FIG. 2 is an elevational view partially in fragmentary section of the combination tool of the invention edging a lens blank.

FIGS. 2–3 illustrate use of the router R for either bevel edging the blank B and/or bevel edging the blank B for further processing with polishing tool P. Should a standard bevel edge be desired for blank B, then the edger H causes the edge 88 of the blank B to engage the router R through cooperative operation of servomotor drives 30 and 60. As best shown in FIG. 2, the edge 88 of blank B initially contacts the blades 108 and 110 intermediate the V-notches 114 and 116 and the proximal end of the blades in order to edge or shape the periphery 88 to a first size and configuration. Those skilled in the art will appreciate that the control provided by servomotor drives 30 and 60 causes their associated tables and hence the blank B and the tool T to move so that the lens blank B achieves a first desired shape and size. After the initial size and shape have been achieved, then the tool T is shifted by servomotor drive 60 so that the periphery 88 of the blank B is engaged by the V-notches 114 and 116, thus forming bevel 158 thereabout, as best shown in FIG. 3. Because of the precision control realizable through the servomotor drive 60 and because the angular position of the blank B is known about its axis of rotation from servomotor drive 36, then the position of the bevel 158 relative to the front and rear surfaces 126 and 124 of blank B, respectively, need not be fixed and may be adjusted to accommodate the opening in the frame chosen. In addition to forming the bevel 158, as best shown in FIG. 3, the blades 108 and 110, when used for standard bevel edging, edge the blank to the finished size, so that the bevel 158 may be snapped into the corresponding groove in the frame opening.

Should it be desirable to polish the edge of blank B, then we control the servomotor drive 30 so that the diameter of the blank B, after engagement with the router R, is approximately 0.40 millimeters larger than would be the final size if polishing were not to occur. The bevel 158 is also slightly larger. The somewhat larger diameter size is utilized because the diamond bond D removes material during polishing, and the amount of material removed needs to be taken into account. Should the diameter of the lens and the bevel 158 not be larger, then the polishing tool P would not be able to remove the score lines. This larger size is automatically provided through operation of servomotor drive 30, such as by the optician operating one of the controls 19 indicating that the edge is to be polished. The blank B should not be too much larger, however, because the polishing tool P removes material less quickly than router R.

Figure 4:
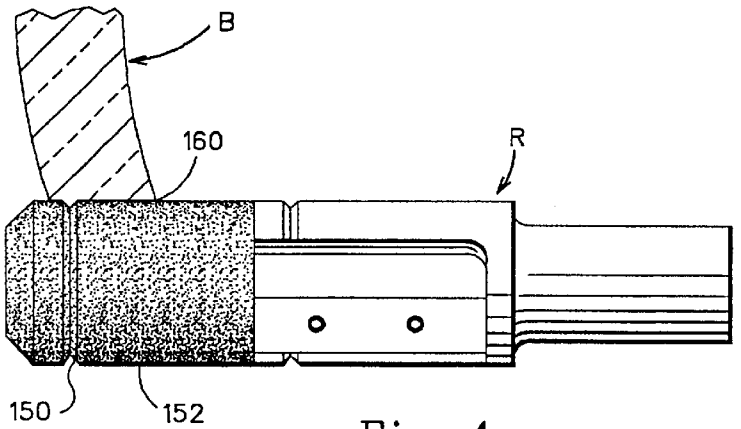
FIG. 4 is an elevational view of the tool and blank of FIG. 3 polishing the edge of the lens blank.

After the blank B has been edged to the somewhat larger size described above, then the servomotor drive 60 shifts the tool T to bring the thus produced distressed edge 128 into operative engagement with the polishing hub P, as best shown in FIG. 4. The bevel 158 is positioned within the V-notch 150 and the periphery 128 of the blank B engaged with the diamond coated periphery 152. The tool T continues to be rotated at high speed by the motor 52, thus causing the diamond particles of the diamond bond D to remove the score lines causing the smokey surface 128, while also reducing the blank B to the finished shape and size.

We have found it advantageous to spray water at the tool T through the nozzle 70 during the polishing step of FIG. 4. The nozzle 70 is on one side of the tool T and the cowl 80 on the opposite side, as best shown in FIGS. 1 and 7. The water supplied from source 60 acts as a lubricant, while also maintaining the temperature of the polishing tool P at a reduced level. We have found that the diamond bond D does not become occluded with the material removed from the blank B, such as could occur if the blank B were to achieve an elevated temperature and become soft. The water spray droplets keep the tool and the blank relatively cool, thus avoiding unnecessary softening of the lens material. While we prefer that water be supplied through the nozzle 70, other fluidic coolants/lubricants may be utilized.

Figure 5:
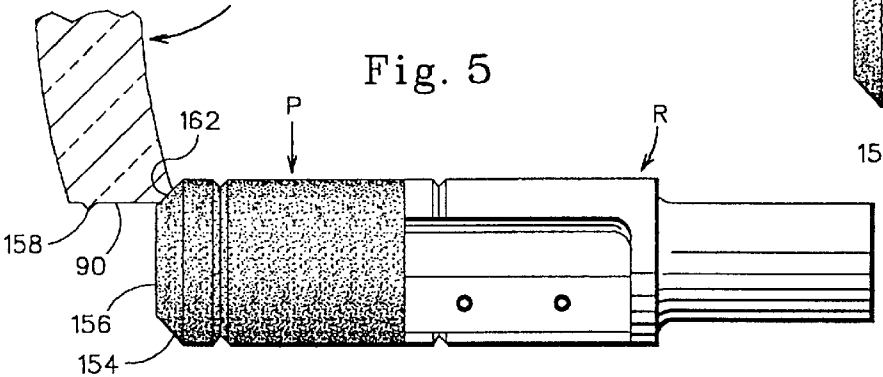
FIG. 5 is an elevational view of the tool and polished blank of FIG. 4 during the formation of a safety bevel about a corner on the lens blank.

The vacuum applied to cowl 80 through line 86 continues to operate not only throughout the router steps of FIGS. 2–3, but also during the polishing and safety beveling steps of FIGS. 4–5. We have found that the vacuum not only causes the fines created during the edging steps to be removed from within the housing of edger H, but the fine water droplets from the nozzle 70 and material removed by tool P also become evacuated. Because the fine water droplets are removed through the cowl 80, then the electrical components within the housing H are protected.

After the edge of the lens has been polished pursuant to FIG. 4 of the invention and/or has been beveled according to FIG. 3, then the sharp corner 160 is removed by engaging the corner 160 with the chamfer 154. Because the chamfer 154 also is coated with diamond bond D, then it likewise polishes the resulting angled surface 162. The blank B is then ready to be snapped into the frame.

While this invention has been described as having a preferred design, it is understood that it is capable of further modifications, uses, and/or adaptations of the invention following in general the principle of the invention and including such departures from the present disclosure as come within known or customary practice in the art to which the invention pertains and as may be applied to the central features hereinbefore set forth, and fall within the scope of the invention of the limits of the appended claims.

What we claim is:

1. A combination tool for edging and polishing the edge of eyeglass lenses, comprising:

a) an axially extending rotatable router body having first and second peripherally disposed and axial extending cutter portions, each cutter portion having a first notch therein for shaping an edge of a lens and said notches being equiaxially spaced along said body and said first notches being aligned; and b) an axially extending polishing tool secured coaxially secured to said body and rotate therewith, said tool having a second notch formed therein for shaping an edge of a lens, a diamond coating applied wholly about said tool exterior surface for polishing the lens edge, and a chamfer extending about a terminal end of said tool for applying a safety edge to said lens.

2. The combination tool of claim 1, wherein:

a) said body and said polishing tool are each generally cylindrical, and said body and said polishing tool have a common diameter.

3. The combination tool of claim 2, wherein:

a) said first and second cutter portions are diametrically opposed.

4. The combination tool of claim 3, wherein:

a) each cutter portion is a blade removably secured to said body.

5. The combination tool of claim 1, wherein:

a) said polishing tool has a proximal end portion mated to said body and a distal end portion, said distal end portion having a chamfer.

6. The combination tool of claim 5, wherein:

a) said second notch is disposed intermediate said chamfer and said proximal end portion.

7. A machine for edging and polishing the edge of an eyeglass lens, comprising:

a) a first table moveable in a first direction, and first drive means for controllably moving said first table in said first direction;

b) a lens clamping and rotating assembly secured to said first table and moveable therewith, said assembly including means for controllably rotating a lens about a first axis extending generally transverse to said first direction;

c) a second table moveable in a second direction perpendicular to said first direction and parallel to said first axis, and second drive means for controllably moving said second table in said second direction;

d) a tool mounted to said second table and moveable therewith, said tool rotatable on a second axis parallel to said first axis and said tool includes a notched edging portion and an abrasive coated portion;

e) means for rotating said tool;

f) a nozzle secured to said second table and moveable therewith, said nozzle disposed adjacent to and aligned with said polishing portion for selectively directing fluid thereto;

g) a vacuum source for operable association with said tool for capturing removed lens material and fluid;

h) said vacuum source includes a conduit secured to and moveable with said second table;

i) a source of liquid in flow communication with said nozzle for causing liquid to be supplied thereto; and j) said conduit includes a portion disposed adjacent said tool.

8. The combination tool of claim 6, wherein:

a) said diamond coating is diamond grit.

9. The combination tool of claim 1, wherein:

a) each of said notches is V-shaped.

10. The combination tool of claim 9, wherein:

a) said notches each have a common size and configuration.

11. The combination tool of claim 10, wherein:

a) said second notch is a continuous groove formed about said polishing tool.

12. A machine for edging and polishing the edge of an eyeglass lens, comprising:

a) a first table moveable in a first direction, and first drive means for controllably moving said first table in said first direction;

b) a lens clamping and rotating assembly secured to said first table and moveable therewith said assembly includes means for controllably rotating a lens about a first axis extending generally transverse to said first direction;

c) a second table moveable in a second direction perpendicular to said first direction and parallel to said first axis, and second drive means for controllably moving said second table in said second direction;

d) a tool mounted to said second table and moveable therewith, said tool rotatable on a second axis parallel to said first axis and said tool comprising a router body having two notched edging portions and a diamond coated polishing portion coaxially secured to said router body and rotatable therewith;

e) means for rotating said tool at a speed of about 20,000 RPMs; and f) a nozzle secured to said second table and moveable therewith, said nozzle disposed adjacent to aligned with said polishing portion for selectively directing coolant fluid thereto.

13. The machine of claim 12, further comprising:

a) a vacuum source for opposable association with said tool for capturing removed lens material and fluid.

14. The machine of claim 13, wherein:

a) said vacuum source includes a conduit secured to and movable with said second table.

15. The machine of claim 12, wherein said tool includes:

a) a chamfered distal end portion.

16. The machine of claim 14, further comprising:

a) a source of liquid in flow communication with said nozzle for causing liquid to be supplied thereto; and b) said conduit includes a portion disposed adjacent said tool.

17. The machine of claim 16, wherein:

a) said conduit portion is disposed on a first side of said tool and said nozzle is disposed on an opposite second side of said tool.

18. A method for edging and polishing the edge of an eyeglass lens, comprising the steps of:

a) providing a polymeric lens blank having an edge;

b) rotating the blank about the geometric axis thereof;

c) engaging the edge with a rotary router cutter rotating at about 20,000 RPMs and causing the edge and the blank to achieve a first distressed configuration having a bevel formed thereabout;

d) thereafter engaging the edge with a diamond coated rotary polishing tool rotating at about 20,000 RPMs, the tool having a notch so that the bevel is positioned within the notch of the tool and thereby causing the edge and bevel to achieve a second polished configuration; and e) directing a lubricant at the polishing tool while the rotating polishing tool is engaged with the edge.

19. The method of claim 1, including the further step of:

a) breaking the exposed corner by engagement with the rotary polishing tool.

* * * * *